US005510769A

United States Patent [19]

Kajfez et al.

[11] Patent Number: 5,510,769

[45] Date of Patent: Apr. 23, 1996

[54] MULTIPLE FREQUENCY TAG

[75] Inventors: Darko Kajfez, University, Miss.; John H. Bowers, Clarksburg, N.J.; Guangun Zhou, University, Miss.

[73] Assignee: Checkpoint Systems, Inc., Thorofare, N.J.

[21] Appl. No.: 108,866

[22] Filed: Aug. 18, 1993

[51] Int. Cl.[6] ..... G08B 13/14

[52] U.S. Cl. ..... 340/572; 336/105

[58] Field of Search ..... 340/572; 336/105

[56] References Cited

U.S. PATENT DOCUMENTS

| | | | |
|---|---|---|---|
| 4,598,276 | 7/1986 | Tait | 340/572 |
| 5,235,326 | 8/1993 | Beigel et al. | 340/572 X |

OTHER PUBLICATIONS

Pantelis Angelidis et al., *IEEE Transactions on Antennas and Propagation, "Lowest Mutual Coupling Between Closely Spaced Loop Antennas"*, vol. 39, No. 7, Jul., 1991.

*Primary Examiner*—Thomas Mullen

*Attorney, Agent, or Firm*—Panitch Schwarze Jacobs & Nadel

[57] ABSTRACT

A multiple frequency tag in one embodiment comprises a generally flat dielectric substrate having first and second generally opposite principal surfaces. A first resonant circuit including a first inductor coil is located on the first surface of the substrate, the first resonant circuit having a first predetermined resonant frequency. A second resonant circuit including a second inductor coil is located on the second surface of the substrate. The second resonant circuit has a second predetermined,resonant frequency which preferably is different from the first predetermined resonant frequency. The first inductor coil is positioned on the substrate to partially overlie the second inductor coil in a manner which minimizes the magnetic coupling between the first and second coils. The tag may be employed in an electronic article security system for protecting articles or may be employed in any other type of system for detecting the presence of a tag and possibly an item attached to the tag.

4 Claims, 2 Drawing Sheets

MULTIPLE FREQUENCY TAG

FIELD OF THE INVENTION

The present invention relates generally to security tags and, more particularly, to a Security tag in which multiple distinct frequencies are employed for enhanced tag detection.

BACKGROUND OF THE INVENTION

The use of electronic article security systems for detecting and preventing theft or Unauthorized removal of articles or goods from retail establishments and/or other facilities, such as libraries, has become widespread. In general, such security systems employ a security tag or tag which is associated with or is secured to an article (or its packaging) of a type which is readily accessible to potential customers or facility users. Security tags may take on many different sizes, shapes and forms depending upon the particular type of security system in use, the type and size of the article, its packaging, etc. In general, such electronic article security systems are employed for detecting the presence (or absence) of a security tag and thus, a protected article, as the protected article passes through or near a surveilled security area or zone. In most cases, the surveilled security area is located at or near an exit or entrance to the retail establishment or other facility.

One such electronic article security system which has gained widespread popularity utilizes a security tag which includes a self-contained, operatively tuned or resonant circuit which resonates at a predetermined detection frequency. When an article having an attached security tag moves into or otherwise passes through the surveilled area, the tag is exposed to an electromagnetic field created by the security system. Upon being exposed to the electromagnetic field, a current is induced in the tag creating a field which changes the field created within the surveilled area. The magnitude and phase of the current induced in the tag is a function of the proximity of the tag to the security system, the frequency of the applied field, the resonant frequency of the tag, and the Q factor of the tag. The resulting change in the field created within the surveilled area because of the resonating security tag can be detected by the security system. Thereafter, the security system applies certain predetermined selection criteria to the detected signal to determine whether the change in the field within the surveilled area resulted from the presence of a tag or resulted from some other source. If the security system determines that the change in the field is the result of the presence of a security tag, it activates an alarm to alert appropriate security or other personnel.

While electronic article security systems of the type described above function very effectively, a limitation of the performance of such systems relates to false alarms. False alarms occur when the field created within the surveilled area is disturbed or changed by a source other than a security tag and the security system, after applying the predetermined selection criteria, still concludes that a security tag is present within the surveilled area and activates an alarm when in fact no security tag is actually present over the years, such systems have become quite sophisticated in the application of multiple selection criteria for security tag identification and in the application of statistical tests in the selection criteria applied to a suspected security tag signal. However, the number of false alarms is still unacceptably high in some applications. Accordingly, there is a need for a security tag for use in such electronic article security systems which provides more information than is provided by present security tags in order to assist such electronic article security systems in distinguishing signals resulting from the presence of a security tag within a surveilled area and similar or related signals which result from Other sources.

One method of providing additional information to the security system is to have two or more security tags each with a different resonant frequency secured to the article being protected. For example, the resonant frequency of a second tag could be offset from the resonant frequency of a first tag by a known ratio. In this manner, the simultaneous detection of two or more signals at specific predetermined separated frequencies each having the characteristics of a security tag signal would have a high probability of indicating the presence of the multiple security tags in the surveilled area since the probability of some other source or sources simultaneously generating each of the multiple signals at each of the predetermined frequencies is very small. It is generally known that when such security tags are placed in close proximity, they also share the magnetic flux generated by one another when current is induced in the tags. The sharing of the flux between the tags creates a coupling of the tags causing the tags to act as a load on one another. The additional loading prevents the tags from resonating at their design resonant frequencies. The tags must, therefore, be widely separated from each other.

The concept of utilizing multiple security tags at different frequencies on each article has not been generally accepted because of the requirement for physically separating the tags by a substantial distance in order to preclude the tags from interacting in such a way that the respective resonant frequencies and Q factors of the tags are detrimentally affected. Placing the security tags at a substantial distance from each other is disadvantageous because at best it requires separate tagging operations thereby substantially increasing the cost of applying the security tags. In addition, some articles are just not large enough to permit the two or more tags to be separated enough to preclude interaction. Separating the tags by a significant distance also affects the orientation and, therefore, the signal strength from the tags thereby limiting detectability of one or more of the tags.

The present invention comprises a multiple frequency security tag for use within an electronic article security system comprised of essentially two or more tags which are in close proximity to each other but in a specific predetermined spatial relationship in which there is zero or near zero coupling between the tags. The specific spatial relationship is one in which the tags partially overlap or overlie each other to the extent that the net flux generated from the coil of one of the tags is substantially zero within the area of the coil of the other tags and vice versa. In effect, with the tags partially overlying each other, flux generated from the current flowing through the coil of any one tag passes through the coils of the other tags in opposite directions so that the flux generated by the one tag passing through the coils of the other tags in a first direction is generally equal in magnitude but opposite in direction to the flux generated by the one tag passing through the coils of the other tags in the opposite direction. In this manner, the net flux flowing through the coils of the other tags from the one tag is zero or near zero and there is no substantial interaction between the tags to diminish the performance of any of the tags.

SUMMARY OF THE INVENTION

Briefly stated, the present invention comprises a multiple frequency security tag which comprises a first security tag having a first resonant circuit including a first inductor coil, the first resonant circuit having a first predetermined resonant frequency. At least one other or second security tag having a second resonant circuit with a second predetermined resonant frequency including a second inductor coil is also provided. The first security tag is secured to the second security tag with the first inductor coil-partially overlying the second inductor coil in a manner which minimizes the magnetic coupling between the first and second inductor coils.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred, it being understood, however, that the invention is not limited to the precise arrangements and instrumentalities disclosed in the drawings.

DETAILED DESCRIPTION OF PREFERRED EMBODIMENTS

Figure 1:
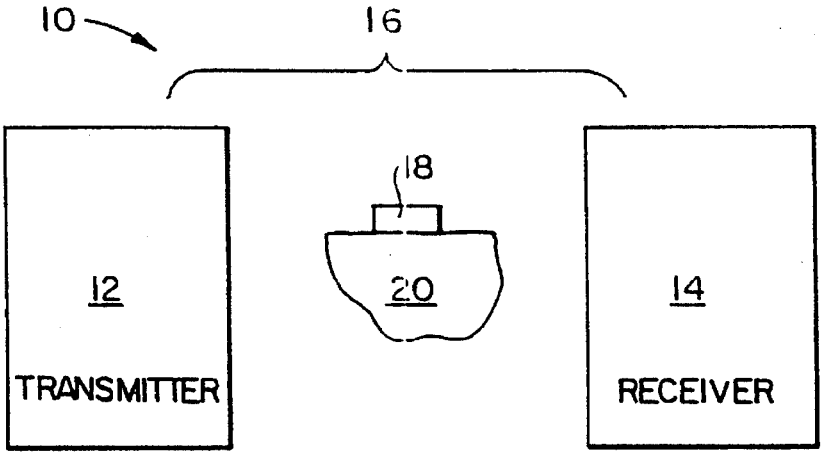
FIG. 1 PRIOR ART
FIG. 1 is a schematic block diagram of a typical electronic article security system in accordance with the present invention.

Referring to the drawings, wherein the same reference numeral designations are applied to corresponding elements throughout the figures, there is shown in FIG. 1 a functional schematic block diagram of an electronic article security (EAS) system 10 in accordance with the present invention. The EAS system 10 includes a detection means, in the present embodiment a transmitter 12 which includes an antenna (not shown) and a receivers 14 also having an antenna (not shown). In the embodiment illustrated by FIG. 1, the transmitter 12 and receiver 14 are spaced apart by a predetermined distance to establish a surveilled area or surveillance zone 16 therebetween. Typically, the spacing between the transmitter 12 and receiver 14 is in the range of from two to six feet depending upon the particular EAS system and the particular application in which the system is being employed. However, the spacing between the transmitter 12 and the receiver 14 could vary if desired. In general, the surveillance zone 16 is at or near the exit or entrance to a facility (not shown) but it could be at any other location such as on either side or within a checkout aisle. It should be appreciated by those skilled in the art that while, in the illustrated embodiment, the EAS system 10 includes a transmitter 12 and a receiver 14 which are separated by a predetermined distance to establish the surveillance zone 16, there are other EAS systems well known to those skilled in the art in which the transmitter and receiver and corresponding antennas are generally co-located, i.e., on the same side of the surveillance zone 16. Accordingly, the particular EAS system 10 and/or configuration illustrated by FIG. 1 is not intended to be a limitation on the present invention.

As is generally well known to those skilled in the art, in EAS systems of the RF type, as illustrated in FIG. 1, the transmitter 12 functions to generate energy at a predetermined frequency which is transmitted through the transmitter antenna to establish an electromagnetic field within the surveillance zone 16. Typically, because of manufacturing tolerances within security tags, transmitters 12 generate energy which is continually swept up and down within a predetermined detection frequency range both above and below a selected center frequency at a predetermined sweep frequency rate. For example, if the desired center or tag frequency to be transmitted is 8.2 Mhz, the transmitter 12 may continually sweep up and down from about 7.6 Mhz to 9.0 Mhz at a sweep frequency rate of 60 Hz. Other frequency ranges and sweep rates are known in the art and are not considered a limitation on the present invention.

The receiver 14 is adapted to continuously monitor the surveillance zone 16. The receiver 14 is synchronized with the transmitter 12 and functions to essentially ignore the basic electromagnetic field generated by the transmitter within the surveillance zone. The receiver 14 thus functions to detect the presence of a disturbance or change within the electromagnetic field of the surveillance zone 16.

The EAS system 10 functions to detect the presence of a security tag 18 within the surveillance zone 16, particularly a security tag 18 secured to an article 20 to be protected. Security tags 18 for use in such EAS systems are generally well known in the art and include a resonant circuit, typically formed of a combination of one or more inductors and one or more capacitors, having a resonant frequency which corresponds to the predetermined center or other frequency within the swept frequency range of the transmitter 12. Thus, in the case of a transmitter 12 having a predetermined or center frequency of 8.2 Mhz, the resonant frequency of the security tag 18 is also 8.2 Mhz. The actual resonant frequency of a given security tag 18 may vary slightly from the desired 8.2 Mhz due to manufacturing tolerances, environmental conditions, or the like. However, the resonant frequency of the security tag 18 in most applications continues to be within the frequency range through which the transmitter 12 sweeps.

When a security tag 18 is present within the surveillance zone 16 and the frequency of the electromagnetic energy from the transmitter 12 corresponds to the resonant frequency of the security tag 18, the security tag 18 resonates at its resonant frequency resulting in a current being induced in the resonant circuit. The magnitude and phase of the current induced in the resonant circuit is a function of the proximity of the tag 18 to the transmitter 12, the frequency of the electromagnetic field, the resonant frequency of the security tag, and the Q factor of the security tag 18. The induced current within the resonant circuit creates a field which alters the field created within the surveillance zone 16 by the transmitter 12. Such a change in the field within the surveillance zone is sensed by the receiver 14. Typically, the presence of a security tag 18 within the surveillance zone 16 results in the generation of a characteristic security tag signal.

Upon detecting the presence of a disturbance or change within the electromagnetic field of the surveillance zone 16, the receiver 14 must make a determination with respect to whether the disturbance was created by the presence of a security tag 18 or by something else. In some cases, the articles themselves or their containers or a surrounding structure or device may resonate at frequencies which are similar to or the same as the resonant frequency of a security tag 18. Extraneous signals such as those presented by radio broadcast stations can also generate signals which may create a disturbance within the security zone which is similar to the disturbance created by the presence of a security tag 18. The receiver 14 applies predetermined selection criteria to each such received disturbance signal and, based upon the applied selection criteria, makes a decision that the disturbance created within the electromagnetic field of the surveillance zone is or is not the result of the presence of a security tag 18 within the surveillance zone 16.

Figure 2:
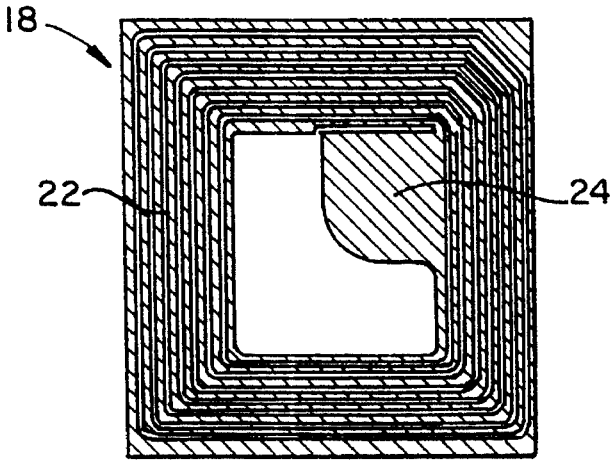
FIG. 2 PRIOR ART
FIG. 2 is a top plan view of a typical prior art single resonant frequency security tag.
Figure 3:
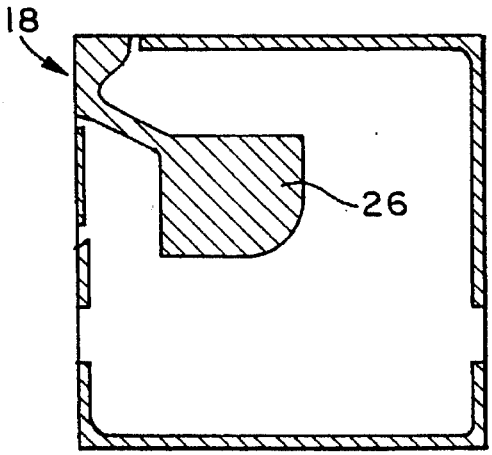
FIG. 3 PRIOR ART
FIG. 3 is a bottom plan View of the security tag shown in FIG. 2.

FIGS. 2 and 3 are a top plan view and bottom plan view, respectively, of a typical prior art single resonant frequency security tag 18. As used herein, the terms security tag or tag are used interchangeably and include a device capable of being detected for security or any other purpose. Security tags of this type are usually created by a lamination and etching process which effectively results in a thin printed circuit or pattern of aluminum or some other conductive metal on both major surfaces of a thin film dielectric substrate, typically a polymeric material. The resonant circuit of the security tag 18 is formed by an inductor connected in parallel with a capacitor. In the typical single resonant frequency embodiment shown in FIGS. 2 and 3, the inductor element is formed by a coil pattern 22 on the top surface of the tag 18. The two larger aligned conductive lands 24, 26 on either major surface of the substrate establish the plates of the capacitor with the substrate forming the dielectric between the two plates. The precise layout of the coil pattern 22 and conductive lands 24, 26 on the major surfaces of the substrate is established by the desired values of the inductor and capacitor elements necessary to establish the desired resonant frequency of the tag 18. Security tags 18 of the type illustrated in FIGS. 2 and 3 are generally well known in the art and a further explanation of the structure, operation or method of fabrication of such tags is not necessary for a complete understanding of the present invention. It will be appreciated by those skilled in the art that tags may be made in a different manner, for example, with discrete electrical components and a wound coil.

Figure 4:
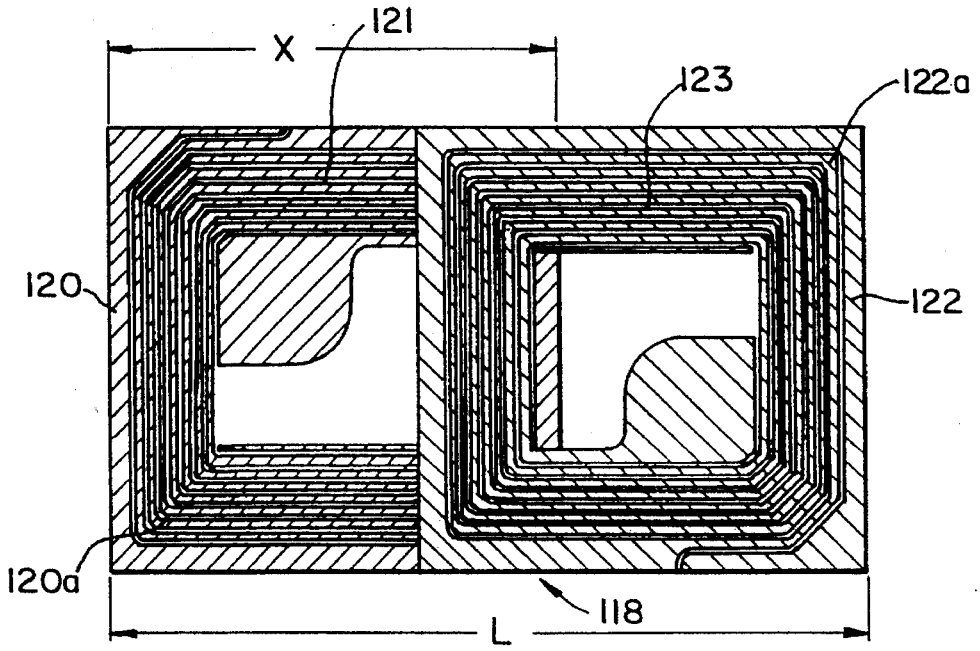
FIG. 4 is a top plan view, of a first embodiment of a dual resonant frequency security tag in accordance with the present invention.

As discussed above, while the desirability of providing two or more separate security tags 18 on an article 20 to be protected has been well known, as also discussed above, the use of two or more separate security tags 18 has not been generally implemented. FIG. 4 shows a dual resonant frequency composite security tag 118 in accordance with a first preferred embodiment of the present invention. The tag 118 is formed by securing together in a predetermined manner a first security tag 120 and a second security tag 122. The first security tag 120 has a first resonant circuit including a first inductor coil 121 and at least one capacitor. The resonant circuit of the first security tag 120 has a first predetermined resonant frequency.

The second security tag 122 also has a second resonant circuit formed of a second inductor coil 123 and at least one capacitor. The resonant circuit of the second tag 122 has a second predetermined resonant frequency which is different from the first predetermined resonant frequency of security tag 120.

The first and second security tags 120, 122 may be separately formed utilizing any known or traditional tag fabrication techniques well known to those skilled in the EAS art. After being fully separately formed, the two tags 120, 122 are secured together with the first inductor coil 121 of tag 120 partially overlapping or overlying the second inductor coil 123 of tag 122 in a manner which minimizes the magnetic coupling between the inductor coils. More specifically, the tags 120, 122 are positioned with the coils 121, 123 partially overlying each other so that the net flux generated from the coil 121 of the first tag 120 is substantially zero within the area of the coil 123 of the second tag 122 and the net flux generated from the coil 123 of the second tag 122 is substantially zero within the area of the coil 121 of the first tag 120. When such a partial overlying of the inductor coils exists, flux generated from current flowing through the coil of one of the tags travels through the other tag in two opposite directions. Properly positioning the tags with respect to one another results in the flux generated by one tag passing through the coil of the other tag in a first direction being equal in magnitude to the flux generated by the one tag passing through the coil of the other tag in the opposite direction. Since the magnitudes of the flux passing in the two opposite directions is equal or nearly equal, the net flux flowing through the other tag as a result of the current flow within the one tag is zero or near zero resulting in the coupling between the tags 120, 122 being zero or near zero. In this manner, the tags 120, 122 function essentially independently of each other. Thus, two tags having two different resonant frequencies may be positioned in close physical proximity to each other resulting in the tags being physically effectively a single tag. Because of their close proximity, signals received in the receiver 14 as a result of the two tags 120, 122 being present within the detection zone. 16 have essentially the same amplitudes thereby facilitating more accurate tag detection than was possible with a single tag 18 resonating at a single frequency.

The two tags 120, 122 may be secured together utilizing a suitable adhesive or other means known in the art. In the embodiment illustrated in FIG. 4, the tags 120, 122 are oriented with the coil sides facing in the same direction and with the capacitors located in diagonally opposite corners. If desired, the tags could be in some other orientation, i.e., coil sides facing each other or coil sides facing away from each other. Also, one or both of the tags 120, 122 could be turned or rotated so that the capacitive lands are in a different location with respect to each other either with the tags in the illustrated orientation (i.e., both coil sides facing the same direction) or in a different orientation. Virtually any orientation or type of overlying relationship could be employed. For example, the tags 120, 122 could be turned so that only a corner **120*a* of tag 120 overlies a corner 122*a* of tag 122**.

Figure 5:
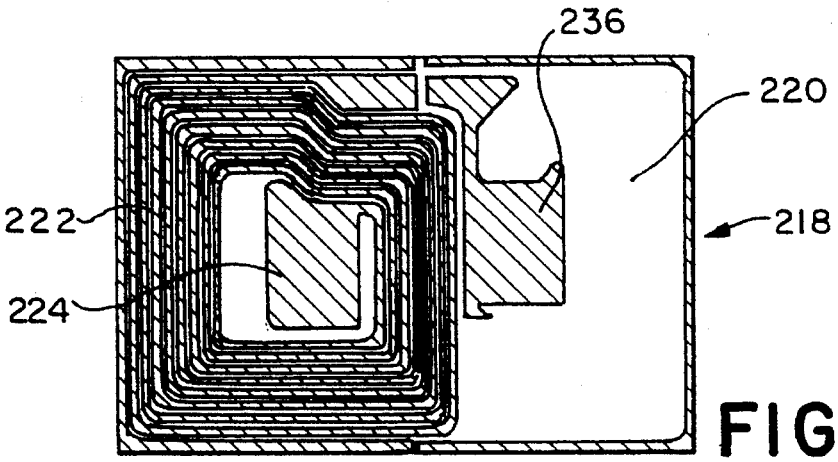
FIG. 5 is a top plan view of a second embodiment of a dual resonant frequency security tag in accordance with the present invention.
Figure 6:
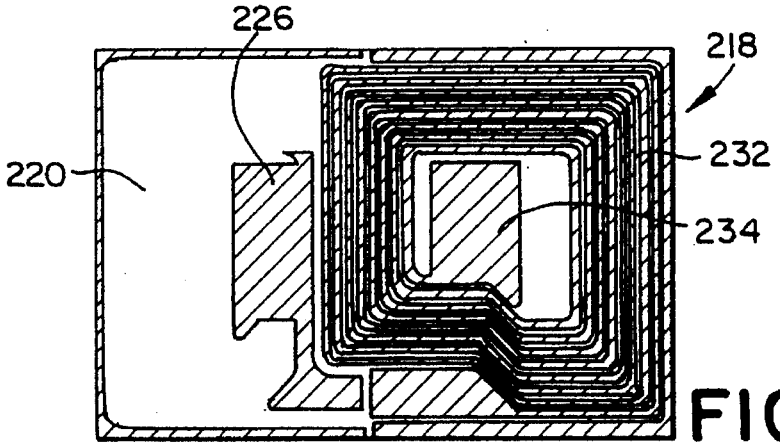
FIG. 6 is a bottom plan view of the security tag of FIG. 5.

FIGS. 5 and 6 show a dual frequency tag 218 in accordance with a second preferred embodiment of the present invention. Unlike the tag 118 of FIG. 4 which was formed by securing together two separate and independent tags 120, 122, tag 218 of the present embodiment is formed as a single tag with two separate resonant circuits which resonate at different predetermined frequencies. Tag 218 includes a single generally flat dielectric substrate 220 having first and second generally opposite principal surfaces. A first resonant circuit including a first inductor coil 222 substantially located on the first surface of the substrate and at least one capacitor formed of conductive lands 224, 226 on both sides of the substrate 220 is formed in the usual manner. The first resonant circuit has a first predetermined resonant frequency established by the values of the inductor/capacitor. A second resonant circuit is formed of a second inductor coil 232 substantially located on the second principal surface of the substrate 220 and at least one capacitor formed of conductive lands 234, 236 on both sides of the substrate. The second resonant circuit has a second predetermined resonant frequency established by the values of the inductor/capacitor which preferably is different from the first predetermined resonant frequency in order to facilitate separate and independent detection of the resonance of each of the resonant circuits.

The key to forming the tag 218 is that the first inductor coil 222 of the first resonant circuit is positioned on the first principal surface of the substrate 220 so as to partially overlie the second inductor coil 232 which is positioned on the second principal surface of the substrate 220 in a manner which minimizes the magnetic coupling between the first and second coils 222, 232. Proper positioning of the inductor coils 222, 232 in an overlying manner results in the net flux generated from one coil being zero or near zero within the area of the other coil in the manner described above with respect to the first embodiment.

The relationship between the inductor coils 222, 232 and the capacitor lands 224, 226, 234, 236 as shown in FIGS. 5 and 6 is only for the purpose of illustrating the present embodiment and may change, consistuent with maintaining the overlying relationship of the inductor coils 222, 232, if desired. For example, the capacitor lands 224, 226, 234, 236 may be further spaced apart or may be placed on diagonally opposite corners. Thus, the specific orientation of the components shown in the figures is not meant to be a limitation upon the present invention. In addition, if desired, each resonant circuit could comprise more than one capacitor.

In forming the tags 118, 218 of either of the above-disclosed embodiments, the precise relationship between the two inductor coils is a function of the specific geometry of the inductor coils and any other elements which control or affect the path of the magnetic flux. With the range of possible coil geometries and other elements which affect the path of the magnetic flux, for example, conductive lands 234, 236 which, in conjunction with the dielectric, form the capacitor of the resonant circuit, it is impossible to give a precise formula for the amount of overlap that will result in zero or near zero coupling between the inductors of the tags. However, by example, referring to FIG. 4, which shows the case for two generally rectangular tags; the ratio of the dimensions X/L generally falls between the range of 0.5 and 1. Coil shapes which are generally not open and of a higher degree of complexity may cause overlaps which are outside of this range. In any case, the coupling between tags can be measured by driving a first tag coil with a current and measuring the induced voltage in a second tag coil as a function of its position relative to the first tag coil. The voltage induced in the second tag coil should be minimized by moving the tags relative to each other to minimize the coupling between the two tags.

Tags having two or more resonant frequencies in accordance with either of the above-described embodiments may be employed in connection with an existing EAS system 10 for enhanced tag detection. As long as each of the resonant frequencies of the tag are within the range of the frequencies swept by the transmitter 12, no substantial modification need be made to the transmitter 12. To enhance the ability of the receiver 14 to discriminate between the multiple frequency tag and other signals within the surveillance zone 16, the detection algorithms of the receiver 14 are modified to look for each of the different resonant frequencies of the tag. In addition, the alarm enabling portion of the receiver is modified so that an alarm is not sounded unless the receiver detects and verifies the simultaneous presence of a tag within the detection zone 16 which is resonating at each of the two or more predetermined resonant frequencies.

It should be understood by those skilled in the art that while the illustrated embodiments of the present invention are shown and described as being employed in an electronic article security system 10, this is not meant to be a limitation upon the present invention. Multiple frequency security tags may be employed in many other types of systems. For example, multiple resonant frequency tags may be used to verify the identity of persons or objects or for establishing the precise location of such persons or objects. As a specific example, such multiple frequency security tags may be secured to packages or luggage to establish the correct routing or instantaneous location of such packages or luggage using a frequency based detection system.

It will be appreciated by those skilled in the art that changes could be made to the embodiments described above without departing from the broad inventive concept thereof. For example, while the tags 118, 218 described above relate to two resonant frequencies, it will be appreciated that each tag may have more than two resonant frequencies. In addition, while the tags 118, 218 as described are a particular type of thin film tag, other types of tags which are fabricated in other manners using other materials may also be employed as multiple frequency tags. It is understood, therefore, that this invention is not limited to the particular embodiments disclosed, but it is intended to cover modifications within the spirit and scope of the present invention as defined by the appended claims.

We claim:

1. A multiple frequency security tag, the tag comprising:

a generally flat dielectric substrate having first and second opposite principal surfaces;

a first resonant circuit including a first inductor coil located on the first surface of the substrate, the first resonant circuit having a first predetermined resonant frequency; and a second resonant circuit including a second inductor coil located on the second surface of the substrate, the second resonant circuit having a second predetermined resonant frequency, wherein the first inductor coil is positioned on the substrate to partially overlie the second inductor coil in a manner which minimizes magnetic coupling between the first and second coils.

2. A multiple frequency composite security tag comprising:

a first security tag having a first resonant circuit including a first inductor coil, the first resonant circuit having a first predetermined resonant frequency; and a second security tag having a second resonant circuit including a second inductor coil, the second resonant circuit having a second predetermined resonant frequency, wherein the first security tag is secured to the second security tag with the first inductor coil partially overlying the second inductor coil in a manner which minimizes the magnetic coupling between the first and second inductor coils.

3. A method of making a multiple frequency composite security tag comprising the steps of:

(a) providing a first security tag having a first resonant circuit including a first inductor coil, the first resonant circuit having a first predetermined resonant frequency;

(b) providing a second security tag having a second resonant circuit including a second inductor coil, the second resonant circuit having a second predetermined resonant frequency; and (c) positioning the first and second security tags with respect to each other so that the first inductor coil partially overlies the second inductor coil in a manner which minimizes magnetic coupling between the first and second coils.

4. A method of detecting the presence within a surveilled area of a security tag having multiple resonant circuits which resonate at different frequencies within a detection frequency range, the method comprising the steps of:

establishing an electromagnetic field within the surveilled area, the frequency of the electromagnetic field varying within the detection frequency range;

detecting disturbances within the surveilled area caused by resonances within the electromagnetic field;

comparing the frequencies of the detected disturbances with the predetermined resonant frequencies of the security tag; and confirming the presence of a security tag within the surveilled area only if a disturbance is detected at each predetermined resonant frequency of the security tag, wherein each resonant circuit of the security tag partially overlies at least one other resonant circuit of the security tag in a manner which minimizes magnetic coupling between said overlying circuits.

* * * * *